United States Patent [19]

Wells et al.

[11] Patent Number: 4,832,852

[45] Date of Patent: May 23, 1989

[54] NONWOVEN OIL ABSORBING MATERIAL AND METHOD

[75] Inventors: Gary G. Wells, Greenville; Kenneth L. Crook, Greer, both of S.C.

[73] Assignee: John D. Hollingsworth On Wheels, Inc., Greenville, S.C.

[21] Appl. No.: 34,449

[22] Filed: Apr. 6, 1987

[51] Int. Cl.[4] ..... C02F 1/40; E02B 15/04

[52] U.S. Cl. ..... 210/671; 134/6; 210/680; 210/691; 210/693; 210/924

[58] Field of Search ..... 210/671, 680, 691, 693, 210/799, 505, 507, 508, 924; 134/6

[56] References Cited

U.S. PATENT DOCUMENTS

| | | | |
|---|---|---|---|
| 3,630,891 | 12/1971 | Peterson et al. | 210/691 |
| 3,962,083 | 6/1976 | Goldman | 210/671 |
| 4,371,441 | 2/1983 | Mathes et al. | 210/799 |

*Primary Examiner*—Ivars Cintins

*Attorney, Agent, or Firm*—Cort Flint

[57] ABSTRACT

A method of removing oil from a surface contaminated with oil comprises spreading elongated mat (A) of nonwoven cotton fiber on the surface of the oil to absorb the oil. The mat is prepared by forming cotton fibers into at least a first nonwoven fiber web (30) and a second nonwoven fiber web (32). A composite is formed by arranging the first and second fiber webs together with a scrim (34) intermediate the first and second fiber webs. The composite is delivered to a needle punch machine (54) and the first and second fiber webs are needle punched into the scrim. The mat is formed in a continuous length greater than its width. The cotton waste fibers are short and are needle punched and compacted into the scrim. Compacted interlocked mat (A) has sufficient strength to facilitate feeding of the mat longitudinally onto the oil (14) and surface, and pulling longitudinally from the surface after absorbing oil through an oil removal device (24) from said mat.

20 Claims, 2 Drawing Sheets

NONWOVEN OIL ABSORBING MATERIAL AND METHOD

BACKGROUND OF THE INVENTION

Today, as never before, oil spills from off shore accidents by oil transporting vessels and drilling operations have been causing hundreds of millions of dollars of damages world wide. More important is the damage done to marine and shoreline facilities. Wildlife and marine life are a grave concern to all. Wildlife is being decimated in many areas. As more super tankers ply the waters of the world spilling oil and offshore wells spill oil, there is an ever increasing threat to the environment.

Various chemicals have been used such as detergents and surface active agents to dispense oil spills. In most cases they only spread the spills over a larger area. Also, these chemicals are pollutants which kill marine life. In most cases the chemicals are expensive and the oil cannot be salvaged for processing.

Several oil absorbing materials have been used such as straw or vermiculite to spread on the surface of the water where the oil leakage occurs. These items have good absorption advantages. However, when these materials are recovered they ultimately become waste products and oil cannot be recovered. Saw dust is another particulate used for such oil spills on water, highways, drilling rigs, manufacturing areas and on the ground along beaches and coastal locations. The disadvantage of saw dust is that it forms a fine dust which is highly inflammable and can cause a dust explosion. Also, it is difficult to retrieve in most areas where it is applied.

Numerous materials and methods had been proposed for oil absorption and removal. U.S. Pat. No. 3,536,616 discloses discreet particles of light weight material which are coated with a fluid sealant and a material having a high affinity for oil. The particles are spread on the water to absorb the oil and collected for oil removal.

U.S. Pat. Nos. 4,340,486; and 3,607,741 disclosed the use of strips of netting and cellulosic material contained in the netting for contacting an oil spill on water to either contain the oil spill or absorb the same on water.

U.S. Pat. No. 4,006,079 discloses a mat of glass fibers bonded to a scrim net for increased oil absorption and strength. U.S. Pat. No. 3,962,083 discloses a method of treating a shore line contaminated from an oil spill wherein a web is formed of cellulosic fibers absorbs the oil. The web may consist of two layers of fibers supported on an intermediate scrim which is netting. Alternately, a layer of shredded oil absorbing material may be contained between two layers of plastic netting and stitched together.

While the above may be suitable for some applications, the need for a method and material to absorb oil, particularly large quantities from oil spills on water, which is sufficiently inexpensive and efficiently strong and oil absorptive still exists.

It has so been proposed to form a carded or cross-lapped web of polypropylene material stitched longitudinally to hold the fibers together and use the material for oil absorption. However, tensile strength is limited and the material is suitable mainly for dispersement from relatively short rolls, and for oil absorption around equipment and in areas where oil spill may occur. Further, it is known to utilize a melt-blown web of polypropylene material for oil absorption. Neither of the latter two nonwoven fabrics have sufficient strength for use in wide rolls of sufficient length to permit the same to be used for oil spill recovery on the surface of water in a method wherein the material may be unwound from one barge and rewound at another.

Generally, nonwoven webs have been formed from synthetic materials such as polyproplyene, polyester, and rayon for a variety of purposes.

Dispersement of the oil from the area in which the spill occurs and disposal or recovery of the oil once it is controlled by efficient and economical materials and methods are problems to which considerable attention need be given.

Accordingly, an object of the invention is to provide a simple and reliable manner of controlling oil spills and recovery of the oil thereafter.

Another object of the invention is to provide an improved oil absorbent, fabricated fibrous material which can easily absorb oil on water and land with retractive capabilities.

Still another object of the invention is to provide a material web consisting of cotton waste materials for oil spill recovery having sufficient strength to permit unwinding of long lengths of the web from one barge and rewinding on another barge after absorbing oil from the surface of water.

Yet another object of the invention is to provide a method and material for absorbing oil from a surface wherein short cotton waste fibers are formed into a nonwoven web and needled into a scrim material resulting in a strong and inexpensive material for oil spill recovery.

More particularly, the invention when applied to the oil spill enables efficient, effective and economic oil containment. The recovery of the oil can also be efficient, effective, and economical.

SUMMARY OF THE INVENTION

The invention is a nonwoven fiberous mat for the containment and removal of oil spills and other pollutants from the surface of water and other areas. The method of fabrication and the composition of the mat provides retractile capabilities allowing for maximum recovery of the spilled oil.

The invention uses the cotton waste fibers having very little value to make a nonwoven fibrous mat which can be made in various lengths and widths and subsequently unrolled on land or on water. Later, the material can be retrieved and processed for oil removal by mechanical squeezing. By forming nonwoven fiber webs from the very short fibers of waste cotton, i.e. linters, gin motes, and mill wastes, a very strong, inexpensive, and efficient oil absorbing mat can be had by needle punching two such fiber webs into an intermediate scrim.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
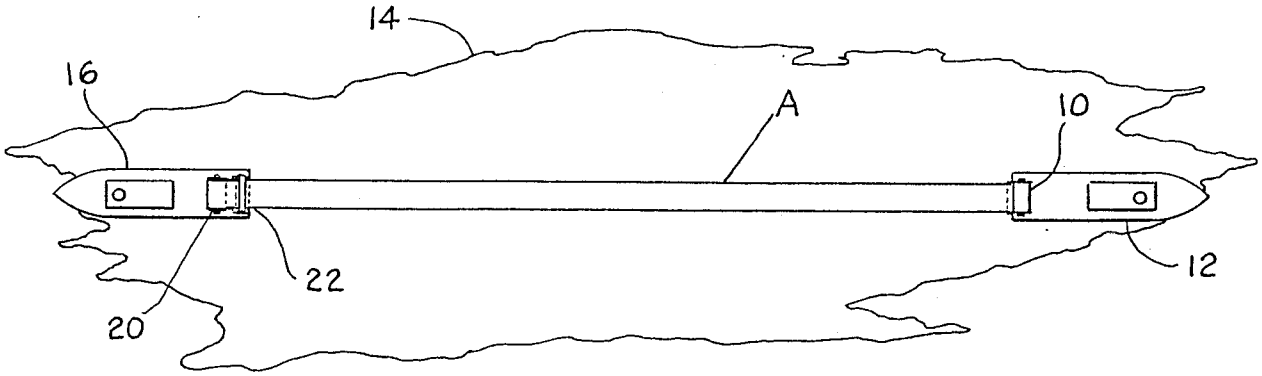
FIG. 1 is a plan view illustrating an oil recovery method in accordance with the invention.
Figure 2:
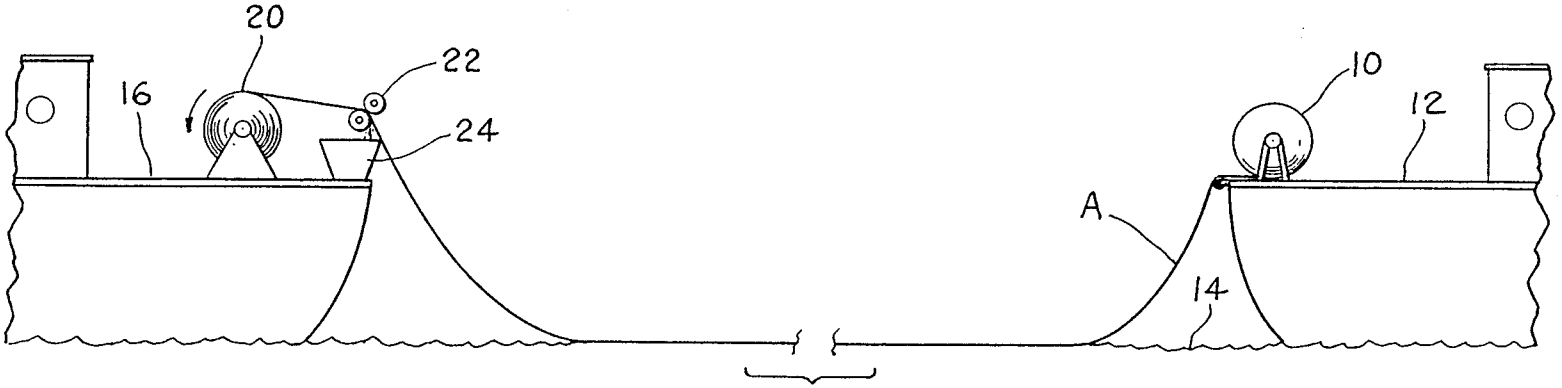
FIG. 2 is a side elevation illustrating a method and material for recovering oil from an oil spill in accordance with the present invention.
Figure 4:
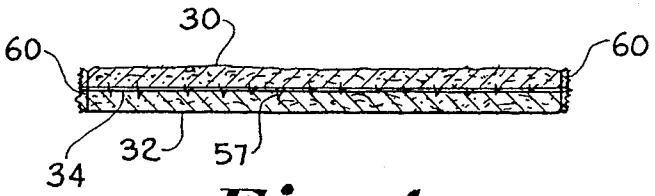
FIG. 4 is a sectional view taken along line 4-4 of FIG. 3.

Referring now in more detail to the drawings, an oil absorbing mat and method for oil removal is disclosed, as can best be seen in FIGS. 1 and 2. An oil absorbing mat A may be dispensed from a roll 10 aboard a barge or ship 12. The mat contacts oil from an oil spill 14 on the surface of the water. A second barge 16 includes a roll 20 upon which the mat is rewound. Prior to rewinding, the mat may be passed through a pair of press rolls 22 for oil removal and collection in vessel 24. In practice, the mat A may be made in widths up to eighty five inches (85") and of any desired length. A number of the mats may be joined across their ends so that a wider mat is formed of a desired width by combining any number of mats A side-by-side. While the invention is illustrated absorbing oil from the surface of water for which it is particularly advantageous, it is to be understood that the invention may also be used for absorbing oil from other surfaces such as a beach, around equipment, and other areas where oil spills are likely to occur.

Figure 3:
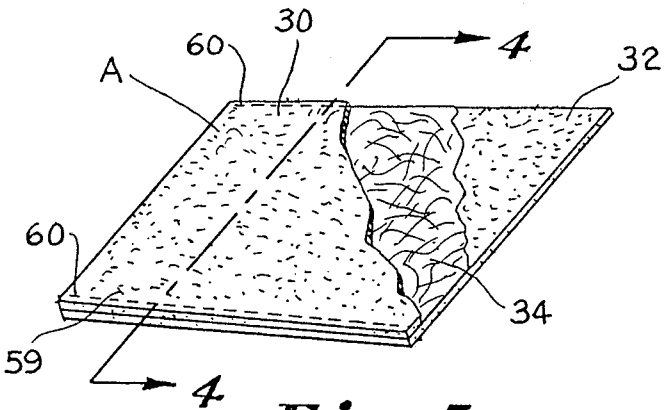
FIG. 3 is a perspective view of a mat constructed in accordance with the present invention for absorbing oil.

Referring now to FIG. 3, the construction of mat A is illustrated as including a first nonwoven cotton fiber web 30 and a second nonwoven cotton fiber web 32 which are needle punched into a scrim material 34. Preferably, scrim 34 is a spunbonded polypropylene or other synthetic spunbonded scrim which gives buoyancy to mat A. Each cotton fiber web 30 and 32 is formed from cotton waste material. Cotton waste material is defined as meaning cotton linters, ginned motes, and mill wastes. Cotton linters are whole and broken lint fibers and fuzz fibers which are removed from the ginned cotton seed by a special ginning process. The linters are then collected and sold for many waste products. In the ginning process, the first ginning of cotton removes most of the lint fibers from the ordinary raw cotton. The seed is then subjected to a second processing on a special gin in which the short fibers, i.e. linters, are shaved from the seed. The linters are composed of a small portion of whole lint fibers, and greater amounts of broken lint fibers, and fuzz fibers, which are much coarser and shorter than the lint fibers. Ordinarily, lint cotton fibers are anywhere from seven eighths to one and one eight inches ($\frac{7}{8}$–$1\frac{1}{8}$") in length. The waste cotton linters are much shorter in the range of one quarter to three eighths of an inch ($\frac{1}{4}$–$\frac{3}{8}$"). Gin motes include two broad categories. Fuzzy motes are the largest type of motes and consist of whole, aborted, or imature seeds covered with fuzz fibers and possibly also with very short lint fibers. Small fuzzy motes originate as either undeveloped or fully grown seeds, which are broken in the ginning process and desintegrate still further in the opening process. A bearded mote is a piece of seed coat with fairly long lint fibers attached. Generally speaking, gin motes are short fibers less than one half inch ($\frac{1}{2}$") in length which fall out under the gin during ginning. Typically, the fibers are from one quarter to one half inch ($\frac{1}{4}$–$\frac{1}{2}$") in length. Mill waste are cotton fibers which fall out of the opening process in the mill. Mill waste fibers are typically one quarter to three quarter inches ($\frac{1}{4}$ to $\frac{3}{4}$") in length. Cotton waste fibers as defined include short cotton fibers retrieved from cotton fibers during ginning and opening which have a length less than about one half an inch ($\frac{1}{2}$"). A very small portion of mill waste fibers may include longer fibers up to three quarters of an inch ($\frac{3}{4}$"). The cotton waste fibers are to be distinguished from the lint cotton fibers which are much longer as described above. The nonwoven, carded webs 30 and 32 may also include some leaf trash.

The scrim is preferably a spunbonded material formed from polyethelyne or other synthetic polymeric material such rayon or polyester. A suitable spunbonded scrim material is manufactured by Kimberly Clark Corp. of Roswell, Georgia and has a weight of one ounce per square yard. The synthetic material provides buoyancy to the mat.

Figure 5:
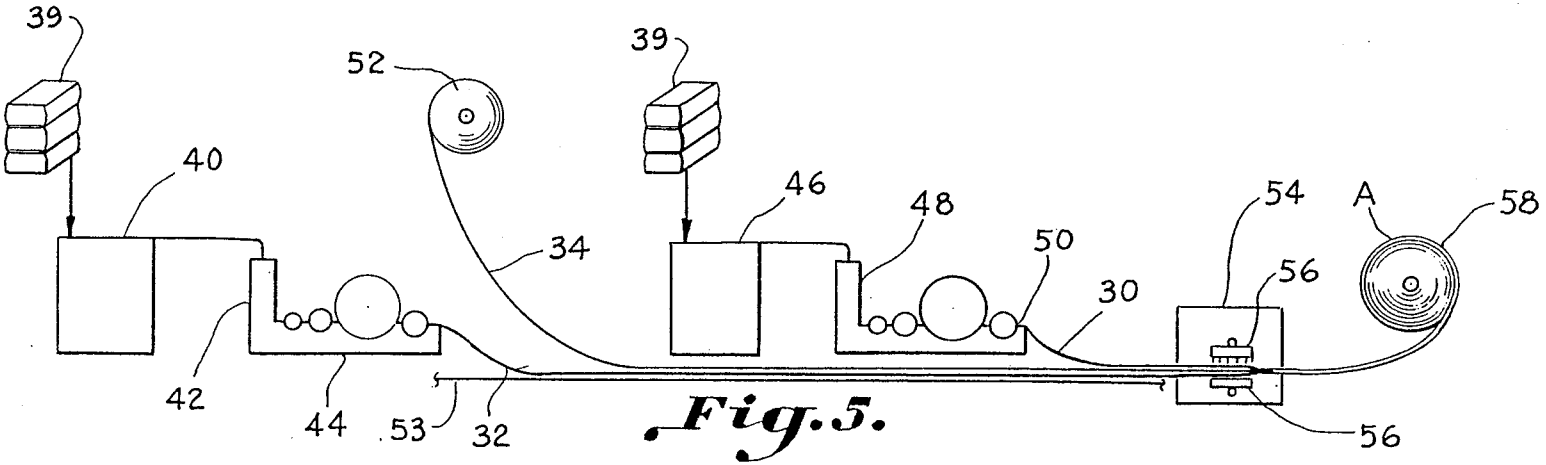
FIG. 5 is a schematic view illustrating a method for an oil absorbing mat constructed in accordance with the present invention for absorbing oil.

Referring now to FIG. 5, the making of oil absorbing mat A is illustrated. Cotton waste fibers which may include any one or any combination of the above three described linters, motes, or mill waste may be fed from a source such as bale 39 to a conventional fiber opener 40. Typically, waste fibers are baled after collection and need to be removed from the bale and opened. The waste fibers are opened and fed to a chute feed 42 of a carding machine 44. By carding, the fibers are individualized and arranged in a parallel manner, and delivered from the carding machine in the form of nonwoven cotton fiber web 32. The opening and carding of fibers opens the fibers out individually and generally straight and parallel. The fibers are more exposed for oil adherence and absorption than when compacted in tufts in the bale. A second production line consisting of a second fiber opener 46 is included. Fiber opener 56 feeds fibers to a chute feed 48. A second carding machine 50 is fed fibers from chute feed 48 in a conventional manner and forms second nonwoven carded webs 30 of waste fibers. A roll 52 contains scrim material 34 and feeds the scrim material between fiber web 30 and 32. Preferably, the webs and scrim are secured by mechanical means such as stitch bonding or needle punching rather than chemical bonding. Needle punching is preferred for reasons which will become more apparent.

In practice, carding machines 44 and 50, with the roll of scrim 34 in between, are installed above a conveyor 53 in a production line so that web 30 is first laid on the conveyor. Scrim 34 is next laid on top of web 30 and web 32 is laid on scrim 34. Additional sets of carding machines and scrim rolls are added to the production line as needed for additional layers. A split web carding machine may be employed where only light weight webs are needed.

The three composite layers of material are then delivered to a conventional needle punch machine 54. The fiber webs 30 and 32 are needle punched by the heads 56 into scrim 34. During this process fibers 57 from fiber webs 30 and 32 are be needle punched into each other by varying amounts. The amount of needle punching may be provided as needed for strength. The result is a strong, nonwoven, compact, composite oil absorbing mat which may be taken up on roll 58. Owing to the shortness of the cotton waste fibers, mat A formed by needle punching fiber webs 30 and 32 into scrim 34 consists of very dense and compacted fibers. A tighter structure results which has increased strength in the longitudinal and lateral directions. The needle punching and interlocking of fibers trap air in the mat to form integral air cells for natural floatation. The synthetic scrim also gives buoyancy to the mat. The fibers 59 are generally parallel and aligned in the longitudinal direction (machine direction) of mat A as it passes through the needle punch machine and as it is used. This provides tensile strength as friction is required to slide the fibers past one another longitudinally. The marginal edges of mat A may be stitched with waxed thread 60 to keep a tear from commencing at the edge.

Natural oils are present on the cotton fibers which have a higher affinity for oil than water. Generally, the cotton fibers are hydrophobic. The result is a composite mat which floats very well on water and has a very large capacity to pick up and/or absorb oil. Since water is shed by the mat, it does not become too heavy and has sufficient strength for rewinding and oil removal. Collected oil squeezed from the mat may be reused.

Additional chemical treatment of fiber webs 30 and 32 may be had after formed by powder spray and the like to provide water repellancy if needed. It is believed that the cotton waste fibers themselves will have a high enough affinity and absorption for the oil to recover in excess of thirty times its weight. Mat A may be used in continuous length rolls or may be cut up into pads for shop and industrial uses or may be made into smaller rolls for beach and land use.

While only two webs 30 and 32 are shown punched into intermediate scrim 34, any number of webs may be punched together as desired for strength. Scrim may or may not be needled between each web. Air-laid cotton waste fibers may also be used although a carded web is preferred for the above reasons.

Thus, it can be seen that an advantageous construction and method can be had for oil absorption, removal, and recovery in accordance with the invention. An oil absorbing mat formed from cotton waste materials is inexpensive and strong enough to be used in lengths of several hundred feet for removal of oil spills on water surfaces. Oil may be recovered from the absorbant material by running it through ringer rolls or other means. Any number of rolls may be used side-by-side to provide a wider roller. The ends may be bound across each other by any suitable binding.

While a preferred embodiment of the invention has been described using specific terms, such description is for illustrative purposes only, and it is to be understood that changes and variations may be made without departing from the spirit or scope of the following claims.

What is claimed is:

1. A method of removing oil from a surface contaminated with oil comprising feeding elongated mats of nonwoven cotton fibers onto said surface to absorb the oil and removing the elongated mat from said contaminated surface by lifting and pulling the elongated mats to which said oil is adhered and absorbed from said surface; said mat being prepared by forming cotton fibers into at least a first nonwoven fiber web and a second nonwoven fiber web by carding said cotton fibers to open and arrange said fibers generally parallel in said webs; forming a composite by arranging said first and second fiber webs together with a scrim intermediate said first and second fiber webs; delivering said composite to a needle punch machine and needle punching said first and second fiber webs into said scrim; forming said mat in a continuous length being greater than its width; said cotton fibers needle punched and compacted into said scrim to provide an integral mat structure for absorbing and removing oil having sufficient strength to facilitate feeding of said mat longitudinally onto the oil spill on the surface and pulling longitudinally from the surface after absorbing oil for oil removal from said mat.

2. The method of claim 1 including passing said mat through oil removal means for oil removal after removing said mat from said surface.

3. The method of claim 1 wherein said mat is prepared by arranging a scrim between said first and second fiber webs which is formed from a synthetic, polymeric material enhancing the buoyancy of said mat.

4. The method of claim 3 wherein said scrim is constructed from a spunbonded polymeric material.

5. The method of claim 1 wherein said mat is prepared by utilizing cotton waste fibers having a length less than about one half inch which includes notes.

6. A method of removing oil from a surface which has been contaminated comprising contacting said oil on said surface with a mat of cotton waste fibers to absorb the oil wherein said mat is prepared by forming at least a first nonwoven fiber web and a second nonwoven fiber web, said webs being composed substantially of cotton waste fibers having a length of less than about $\frac{3}{4}$ of an inch, feeding said first and second nonwoven fiber webs in a superposed position with a scrim in between to a needle punch machine, and needle punching said first and second fiber webs into said scrim to provide integral fabric structure for absorbing and removing oil; and contacting said oil on said surface with said mat to absorb oil, and removing said mat from said surface to remove said oil.

7. The method of claim 6 wherein said first fiber web is prepared by feeding said cotton waste fibers to a carding machine, carding said cotton waste fibers, and forming said first nonwoven fiber web, and feeding cotton waste fibers to a second carding machine, carding said fibers, and forming said second nonwoven fiber web.

8. The method of claim 7 wherein said mat is prepared by utilizing cotton waste fibers having a length of less than about one half inch and includes notes.

9. The method of claim 6 wherein said mat is prepared by utilizing a scrim constructed from a synthetic polymeric material affording buoyancy to said mat.

10. A method of removing oil from a surface contaminated with oil comprising spreading elongated mats of nonwoven cotton waste fibers on the surface to absorb the oil by unwinding a length of said mat onto said surface, and rewinding said mat after absorbing oil; said mat being prepared by forming cotton waste fibers into a first nonwoven fiber web and a second nonwoven fiber web; said webs being composed substantially of cotton waste fibers having a length of less than about $\frac{3}{4}$ of an inch; forming a composite by arranging said first and second fiber webs together with a scrim intermediate said first and second fiber webs; mechanically securing said first and second fiber webs and said scrim together in said composite in a manner that an integral mat structure is formed; forming said mat in a continuous length being greater than its width; said integral mat structure having sufficient strength to facilitate unwinding of a length of said mat onto said oil on said surface and rewinding said mat after absorbing oil for oil removal from said mat.

11. The method of claim 10 including passing said mat through oil removal means for oil removal after removing said mat from said water surface.

12. The method of claim 10 wherein said scrim is constructed from a spunbonded polymeric material.

13. The method of claim 10 wherein said mat is prepared by utilizing cotton waste fibers having a length less than about one half inch.

14. The method of claim 10 wherein said first fiber web is prepared by feeding said cotton waste fibers to a carding machine, carding said cotton waste fibers, and forming said first nonwoven fiber web, and feeding cotton waste fibers to a second carding machine, carding said fibers, and forming said second nonwoven fiber web in a manner that said fibers extend generally in parallel alignment to the longitudinal direction of said mat.

15. The method of claim 14 wherein said mat is prepared by utilizing cotton waste fibers having a length of less than about one half inch.

16. The method of claim 15 wherein said cotton waste fibers includes one or a combination of cotton linters and gin motes.

17. The method of claim 15 wherein said cotton waste fibers include mill waste cotton fibers.

18. The method of claim 15 wherein said scrim consists of a spunbonded, synthetic material affording buoyancy to said oil absorbing mat.

19. The method of claim 15 including securing marginal edges of said first and second webs together along the length of said mat.

20. The method of claim 15 including treating said cotton fiber webs after formation chemically to increase their water repellancy.

* * * * *